US010828897B2

(12) United States Patent
Kudo et al.

(10) Patent No.: US 10,828,897 B2
(45) Date of Patent: Nov. 10, 2020

(54) INK JET RECORDING METHOD AND INK JET RECORDING APPARATUS

(71) Applicant: CANON KABUSHIKI KAISHA, Tokyo (JP)

(72) Inventors: Satoshi Kudo, Kawasaki (JP); Yuki Nishino, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/605,198

(22) Filed: May 25, 2017

(65) Prior Publication Data

US 2017/0348972 A1 Dec. 7, 2017

(30) Foreign Application Priority Data

Jun. 1, 2016 (JP) ..... 2016-110002
May 22, 2017 (JP) ..... 2017-100599

(51) Int. Cl.

| | |
|---|---|
| ***B41J 2/155*** | (2006.01) |
| ***B41J 2/21*** | (2006.01) |
| ***B41J 2/045*** | (2006.01) |
| ***B41J 2/18*** | (2006.01) |
| ***B41J 2/165*** | (2006.01) |

(52) U.S. Cl.

CPC ..... *B41J 2/155* (2013.01); *B41J 2/04563* (2013.01); *B41J 2/16517* (2013.01); *B41J 2/16585* (2013.01); *B41J 2/18* (2013.01); *B41J 2/2114* (2013.01)

(58) Field of Classification Search

None

See application file for complete search history.

(56) References Cited

U.S. PATENT DOCUMENTS 5,196,860 A * 3/1993 Pickell ..... B41J 2/02 347/75
5,477,246 A * 12/1995 Hirabayashi ..... B41J 2/04528 347/12
6,357,863 B1 * 3/2002 Anderson ..... B41J 2/04541 347/54

(Continued)

FOREIGN PATENT DOCUMENTS

JP 2005-144724 A 6/2005
JP 2008-000975 A 1/2008

(Continued)

*Primary Examiner* — Alejandro Valencia
(74) *Attorney, Agent, or Firm* — Venable LLP

(57) ABSTRACT

An ink jet recording method is capable of suppressing generation of image streaks and recording a high-quality image when using a recording apparatus equipped with a line head. The ink jet recording method records an image on a recording medium by using an ink jet recording apparatus equipped with a line head. In this method, the line head has a plurality of recording element substrates each having a nozzle array made up of a plurality of nozzles which eject an aqueous ink. The recording element substrates are arranged in a predetermined direction. An average temperature Te (° C.) of the aqueous ink ejected from terminal-portion nozzles constituting the terminal portions of the nozzle arrays and an average temperature Tc (° C.) of the aqueous ink ejected from center-portion nozzles constituting the center portions of the nozzle arrays satisfy the following relationship: Te>Tc.

27 Claims, 5 Drawing Sheets

(56) References Cited

U.S. PATENT DOCUMENTS

| | | | | |
|---|---|---|---|---|
| 8,955,936 | B2 * | 2/2015 | Yoshimoto | B41J 2/04553 347/14 |
| 9,004,634 | B2 | 4/2015 | Maesaka et al. | |
| 2006/0214962 | A1 * | 9/2006 | Takata | B41J 2/04508 347/14 |
| 2007/0242098 | A1 * | 10/2007 | Sudo | B41J 2/155 347/40 |
| 2008/0150986 | A1 * | 6/2008 | Ikeda | B41J 2/155 347/12 |

FOREIGN PATENT DOCUMENTS

| | | | |
|---|---|---|---|
| JP | 2008-194940 | A | 8/2008 |
| JP | 2010-143147 | A | 7/2010 |
| JP | 2013-224006 | A | 10/2013 |

* cited by examiner

INK JET RECORDING METHOD AND INK JET RECORDING APPARATUS

BACKGROUND OF THE INVENTION

Field of the Invention

The present invention relates to an ink jet recording method and an ink jet recording apparatus used therefor.

Description of the Related Art

Ink jet recording apparatuses have recently been used increasingly in offices and the like with their advantages such as low electric power, low cost, and saved space. As a scanning type of a recording head used in ink jet recording apparatuses, a serial type can be given as one example. In the serial type, an image is recorded by moving a recording head in repetition in a direction (sub-scanning direction) orthogonal to a paper feed direction (main scanning direction). Since the serial type recording head is relatively small, the recording apparatus itself can have a reduced size.

In recent years, for further improvement in a recording speed (throughput), a recording apparatus using, as a recording head, a line head type one in which an arrangement width of ejection orifices is increased to a width corresponding to the maximum width of a recording medium has been developed (Japanese Patent Application Laid-Open No. 2010-143147). In this line head type, different from the serial type, the recording head is not moved but only paper is conveyed so that it is advantageous for improving a recording speed.

In the line head type, however, there may occur a problem that a "streak" appears on an image recorded at a discontinuous position of nozzle arrays at a boundary portion between recording element substrates (chips) placed adjacent to each other. To overcome such a problem, proposed is a recording head having a heater provided at a boundary between chips to eliminate a temperature difference between the chips (Japanese Patent Application Laid-Open No. 2008-194940). Provided also is an ink jet recording apparatus capable of reducing a temperature drop of chips at a joint portion between chip arrays and thereby suppressing a change in the density of an image recorded at the joint portion (Japanese Patent Application Laid-Open No. 2008-000975).

Provided further is an ink jet printing apparatus capable of improving a printing quality by warming liquid droplets to be ejected from a nozzle array downstream of a printing direction and thereby increasing an ejection speed (Japanese Patent Application Laid-Open No. 2013-224006). Provided still further is a recording apparatus in which an ejection speed of ink droplets to be ejected from a recording head placed on the leading side is set higher than that of ink droplets to be ejected from a recording head placed on the rear side, in a moving direction of a serial type recording head (Japanese Patent Application Laid-Open No. 2005-144724).

SUMMARY OF THE INVENTION

It has however been found that even using the recording apparatus equipped with the recording head proposed in Japanese Patent Application Laid-Open No. 2010-143147, 2008-194940, or 2008-000975 cannot sufficiently suppress generation of image streaks. In addition, even using the ink jet printing apparatus proposed in Japanese Patent Application Laid-Open No. 2013-224006 cannot sufficiently suppress generation of image streaks, but rather an image printed by it sometimes has more noticeable streaks. Further, even using an ink jet recording apparatus similar to that proposed in Japanese Patent Application Laid-Open No. 2005-144724 except for the use of a line head type recording head instead of the serial type, one cannot sufficiently suppress generation of image streaks, but rather it sometimes facilitates generation of image streaks.

An object of the invention is therefore to provide an ink jet recording method capable of suppressing generation of image streaks and thereby recording a high-quality image, when using a recording apparatus equipped with a line head. Another object of the invention is to provide an ink jet recording apparatus to be used for the above-described ink jet recording method.

The above-described objects are achieved by the following invention. According to the invention, provided is an ink jet recording method which records an image on a recording medium by using an ink jet recording apparatus equipped with a line head, wherein the line head has a plurality of recording element substrates each having a nozzle array comprised of a plurality of nozzles, which eject an aqueous ink, arranged in a predetermined direction, the recording element substrates being arranged in the predetermined direction, and wherein an average temperature Te (° C.) of an aqueous ink ejected from terminal-portion nozzles constituting a terminal portion of the nozzle array and an average temperature Tc (° C.) of an aqueous ink ejected from center-portion nozzles constituting a center portion of the nozzle array satisfy the following relationship: $Te>Tc$.

The invention enables to provide an ink jet recording method capable of suppressing generation of image streaks and thereby recording a high-quality image, when using a recording apparatus equipped with a line head. In addition, the invention enables to provide an ink jet recording apparatus to be used for the above-described ink jet recording method.

Further features of the present invention will become apparent from the following description of exemplary embodiments with reference to the attached drawings.

BRIEF DESCRIPTION OF THE DRAWINGS

FIGS. 3A and 3B schematically show one example of a line head, in which FIG. 3A is a perspective view and FIG. 3B is an exploded perspective view.

FIGS. 4A and 4B show one example of a recovery mechanism, in which FIG. 4A is a perspective view and FIG. 4B is a schematic view.

DESCRIPTION OF THE EMBODIMENTS

Figure 1:
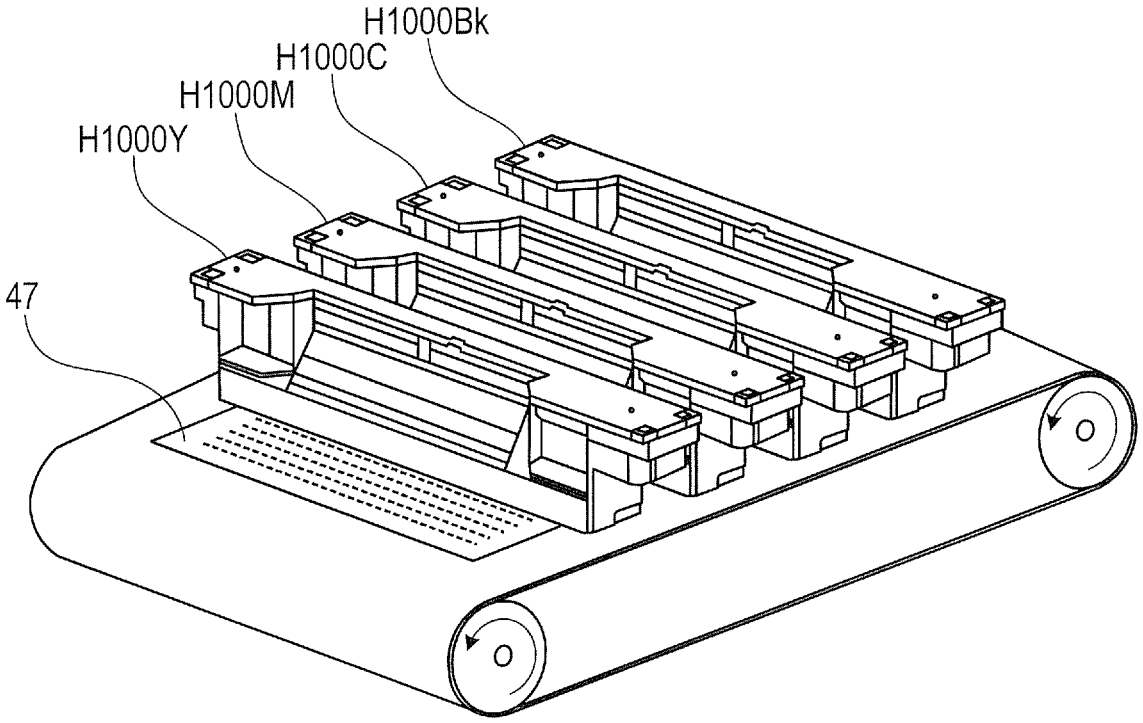
FIG. 1 is a conceptual diagram of recording an image by a line head.

Preferred embodiments of the present invention will now be described in detail in accordance with the accompanying drawings.

The invention will hereinafter be described in further detail by preferred embodiments. In the invention, when a compound is a salt, the salt in an ink is dissociated into ions, but it is expressed as "the ink contains a salt" for convenience sake. An aqueous ink for ink jet may be referred to as "ink" simply. The physical property values are values at normal temperature (25° C.) unless otherwise particularly specified.

<Ink Jet Recording Method>

An ink jet recording method of the invention is a method of recording an image on a recording medium by using an ink jet recording apparatus equipped with a line head. The line head is equipped with a plurality of recording element substrates each having a nozzle array comprised of a plurality of nozzles, which eject an ink, arranged in a predetermined direction. The recording element substrates are arranged in the predetermined direction. An average temperature Te (° C.) of ink ejected from terminal-portion nozzles constituting the terminal portion of the nozzle array and an average temperature Tc (° C.) of ink ejected from center-portion nozzles constituting the center portion of the nozzle array satisfy the following relationship: Te>Tc.

As described above, recording an image on a recording medium by using an ink jet recording apparatus equipped with a line head facilitates generation of "streaks" (image streaks) on the image recorded at a discontinuous position of nozzle arrays (which may hereinafter be referred to as a "joint portion") at a boundary portion between recording element substrates. Such image streaks are likely to occur particularly when an image is recorded on a recording medium having a coating layer such as glossy paper. As a result of investigation on the cause of such image streaks, the present inventors have found the following causes (1) and (2).

Cause (1): Misalignment of the application position of an ink ejected from terminal-portion nozzles that constitute the terminal portion of the nozzle array occurs due to an air flow.

Cause (2): In the case where the plurality of recording element substrates are arranged in a direction equal to the nozzle arrangement direction such that the respective terminal-portion nozzles of the recording element substrates adjacent to each other overlap in a direction intersecting with the nozzle arrangement direction to constitute overlapping portions, dots of an ink ejected from overlapping-portion nozzles constituting the overlapping portions and applied to a recording medium fail to become adequately large.

First, the cause (1) can be presumed as follows. When an image is recorded using an ink jet recording apparatus equipped with a line head, there occur a self-air flow which is an air flow caused by ink droplets themselves ejected from the nozzle and an inflow air flow caused by conveyance of a recording medium. The ink ejected from the center-portion nozzles constituting the center portion of the nozzle array is influenced equally by the respective air flows caused by inks ejected from nozzles both adjacent thereto. The ink ejected from the terminal-portion nozzles constituting the terminal portion of the nozzle array is, on the other hand, different from the above-described one in influential air flow because the terminal-portion nozzles each do not have a nozzle adjacent thereto at their one side and no air flow is caused. Described specifically, since the ink droplets ejected from the terminal-portion nozzles are applied to the recording medium on an orbit different from that of the ink ejected from the center-portion nozzles, image streaks occur. The higher the ink ejection speed, the greater the difference in influential air flow. The misalignment in the application position of the ink ejected from the terminal-portion nozzles tends to increase if the ink ejection speed is simply increased as proposed in Japanese Patent Application Laid-Open Nos. 2013-224006 and 2005-144724.

The inflow air flow caused by the conveyance of the recording medium is blocked by the wall-like self-air flow caused by the ink ejected from the center-portion nozzles and moves toward the terminal-portion nozzles. The inflow air flow therefore selectively influences the ink ejected from the terminal-portion nozzles, leading to generation of image streaks. If the ejection speed of the ink from the nozzle upstream of the conveyance direction of the recording medium is increased as proposed by the Japanese Patent Application Laid-Open No. 2005-144724, the self-air flow becomes stronger, which inevitably increases the misalignment in the application position of the ink ejected from the terminal-portion nozzles.

The cause (2) is presumed as follows. A method of reducing image streaks caused by use of an ink jet recording apparatus equipped with a line head has so far been investigated. For example, it is known that a plurality of recording element substrates is arranged in a direction equal to a nozzle arrangement direction such that respective terminal-portion nozzles of the recording element substrates adjacent to each other constitute overlapping portions in a direction intersecting with the nozzle arrangement direction. Arrangement of the plurality of recording element substrates so as to constitute overlapping portions, however, facilitates generation of image streaks at a position corresponding to overlapping-portion nozzles.

As a result of investigation, the present inventors have built the following hypothesis about the cause of image streaks at a position corresponding to the overlapping-portion nozzles. During recording an image, ink droplets ejected from nozzles other than the overlapping-portion nozzles are connected with each other on a recording medium, which enlarges an ink dot. In the case of the overlapping-portion nozzles, application timing of an ink to a recording medium slightly differs between the nozzle arrays adjacent to each other. The ink droplets are therefore not easily connected with each other on the recording medium, which prevents enlargement of an ink dot. The optical density of an image at a position corresponding to the overlapping-portion nozzles becomes thinner than that of an image at a position corresponding to the nozzles other than the overlapping-portion nozzles, leading to generation of an image streak.

As a result of investigation on both the causes (1) and (2), the present inventors have found that generation of an image streak can be suppressed by adopting the following constitution. Described specifically, generation of an image streak can be suppressed by setting an average temperature Te (° C.) of an ink ejected from terminal-portion nozzles constituting a terminal portion of a nozzle array higher than an average temperature Tc (° C.) of an ink ejected from center-portion nozzles constituting a center portion of the nozzle array. The present inventors have presumed the reason as follows why generation of image streaks can be suppressed by satisfying the above-described condition.

First, the reason why generation of an image streak due to the cause (1) is suppressed is presumed as follows. By setting an average temperature of an ink ejected from the terminal-portion nozzles higher than that of an ink ejected from the center-portion nozzles, an ejection speed of an ink from the terminal-portion nozzles increases without reinforcing the self-air flow of the ink. This is presumed to reduce the influence of an air flow on the ink ejected from the terminal-portion nozzles. It is generally known that the higher the temperature of an ink, the lower the surface tension and viscosity of the ink. It is presumed based on this that due to a decrease in the surface tension and viscosity, the ink ejected from the terminal-portion nozzles blurs more easily on the recording medium. Image streaks appear because the ink is not applied to a position where it should essentially be applied. Since the ink ejected from the terminal-portion nozzles blurs more easily, it blurs even to the position where it should essentially be applied and as a result, generation of image streaks is suppressed.

Next, the reason why generation of an image streak due to the cause (2) is suppressed is presumed as follows. The surface tension and the viscosity of the ink ejected from the overlapping-portion nozzles decrease by setting the average temperature of an ink ejected from the terminal-portion nozzles higher than that of an ink ejected from the center-portion nozzles. This facilitates blur of the ink ejected from the overlapping-portion nozzles on a recording medium and makes the optical density of an image at a position corresponding to the overlapping-portion nozzles closer to that of an image at a position corresponding to nozzles other than the overlapping-portion nozzles. Generation of image streaks can therefore be suppressed.

On a recording element substrate constituting a line head, usually from 100 to 2000 nozzles are linearly arranged to constitute a nozzle array. For the convenience sake, the following description is based on the assumption that the total number of nozzles constituting a nozzle array is "1". In this case, nozzles preferably within a range of "0.5 (±0.25 from the center)", more preferably within a range of "0.25 (±0.125 from the center)", each including the center of the nozzle array, are referred to as "center-portion nozzles". The average temperature of an ink ejected from the center-portion nozzles is referred to as "Tc (° C.)". Of the nozzles constituting the nozzle array, nozzles preferably from the endmost portion to the 15th one toward the center are referred to as "terminal-portion nozzles" and the average temperature of an ink ejected from these terminal-portion nozzles is referred to as Te (° C.). Further, the average temperature Te (° C.) of an ink ejected from the terminal-portion nozzles and the average temperature Tc (° C.) of an ink ejected from the center-portion nozzles preferably satisfy the following relationship: $Te \geq Tc+10$. In addition, the average temperature Tc (° C.) of an ink ejected from the center-portion nozzles is preferably adjusted to 15° C. or more to 60° C. or less. On the other hand, the average temperature Te (° C.) of an ink ejected from the terminal-portion nozzles is preferably adjusted to 25° C. or more to 70° C. or less.

(Ink Jet Recording Apparatus)

The ink jet recording apparatus to be used in the ink jet recording method of the invention is equipped with a line head. The line head has a plurality of recording element substrates each having a nozzle array comprised of a plurality of nozzles, which eject an aqueous ink, arranged in a predetermined direction and the recording element substrates are arranged in the predetermined direction. The apparatus is equipped with a unit for controlling the relationship between an average temperature Te (° C.) of an aqueous ink ejected from the terminal-portion nozzles and an average temperature Tc (° C.) of an aqueous ink ejected from the center-portion nozzles as to satisfy the relationship $Te>Tc$. The ink jet recording apparatus of the invention will hereinafter be described in detail while referring to drawings.

Figure 2:
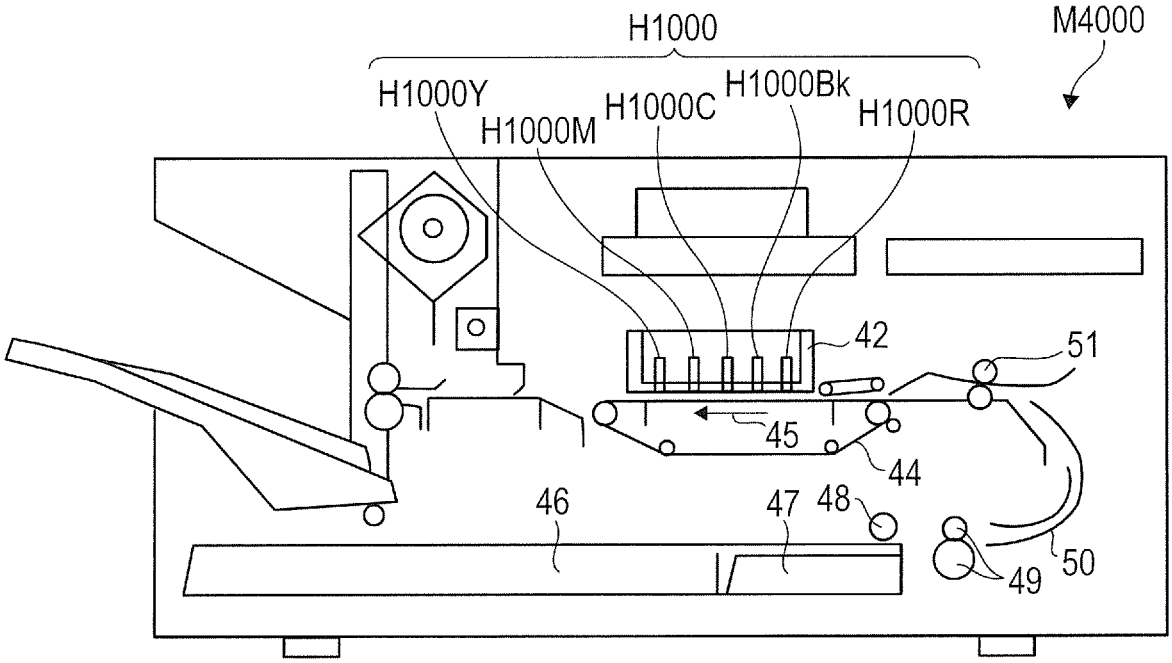
FIG. 2 is a schematic view showing one example of an ink jet recording apparatus.

FIG. 1 is a conceptual diagram of recording an image by a line head; and FIG. 2 is a schematic view showing one example of an ink jet recording apparatus. In a recording apparatus M4000 shown in FIG. 2, a line head (recording head H1000) is fixed to a recording apparatus body and a method of recording while conveying a recording medium 47 in a direction of an arrow 45 is adopted. The recording apparatus M4000 is equipped with, for example, a recording head H1000Y for yellow ink, a recording head H1000M for magenta ink, a recording head H1000C for cyan ink, and a recording head H1000Bk for black ink (FIG. 1).

The recording heads H1000Y to H1000R shown in FIG. 2 are fixed by a recording head holder 42 mounted in the recording apparatus M4000. FIGS. 1 and 2 show a structure in which yellow, magenta, cyan and black colors and a reaction liquid are ejected from recording heads, respectively. Needless to say, another structure may be employed in which an image is recorded by ejecting a plurality of inks and a reaction liquid from a plurality of nozzle arrays provided on one recording element substrate, respectively.

The ink jet recording apparatus may be equipped with a unit for applying, to a recording medium, a reaction liquid containing a component causing aggregation of a coloring material. Examples of the unit for applying the reaction liquid to a recording medium include a unit for applying the reaction liquid to a recording medium by a method of application and a unit for applying the reaction liquid to a recording medium by an ejection method. In the unit for applying the reaction liquid to a recording medium by a method of application, the reaction liquid is applied to the recording medium, for example, by using a conventionally known application member such as roller. In the unit for applying the reaction liquid to a reaction medium by an ejection method, the reaction liquid is applied to the recording medium, for example, by using an ejection device such as the line head for reaction liquid (recording head H1000R) as shown in FIG. 2. When four recording heads corresponding to inks of four colors are provided, respectively, as shown in FIG. 1, another unit for applying the reaction liquid to a recording medium can be provided. In the invention, it is preferred to apply the reaction liquid to a recording medium by a method of application or the like and then apply the inks, which have been ejected from the recording heads, to the recording medium.

A paper feed cassette 46 has therein one or more recording media 47 such as plain paper and it is detachably attached to the recording apparatus body. A pickup roller 48 is a member for sending one sheet on the topmost surface of the recording media 47 housed in the paper feed cassette 46. A conveying roller 49 is a member for conveying the recording media 47 sent by the pickup roller 48 to a conveying path 50. A conveying roller 51 arranged on the outlet side of the conveying path 50 is a member for conveying the recording media 47 toward the recording head H1000 while having the media on a conveying belt 44.

Figure 3A:
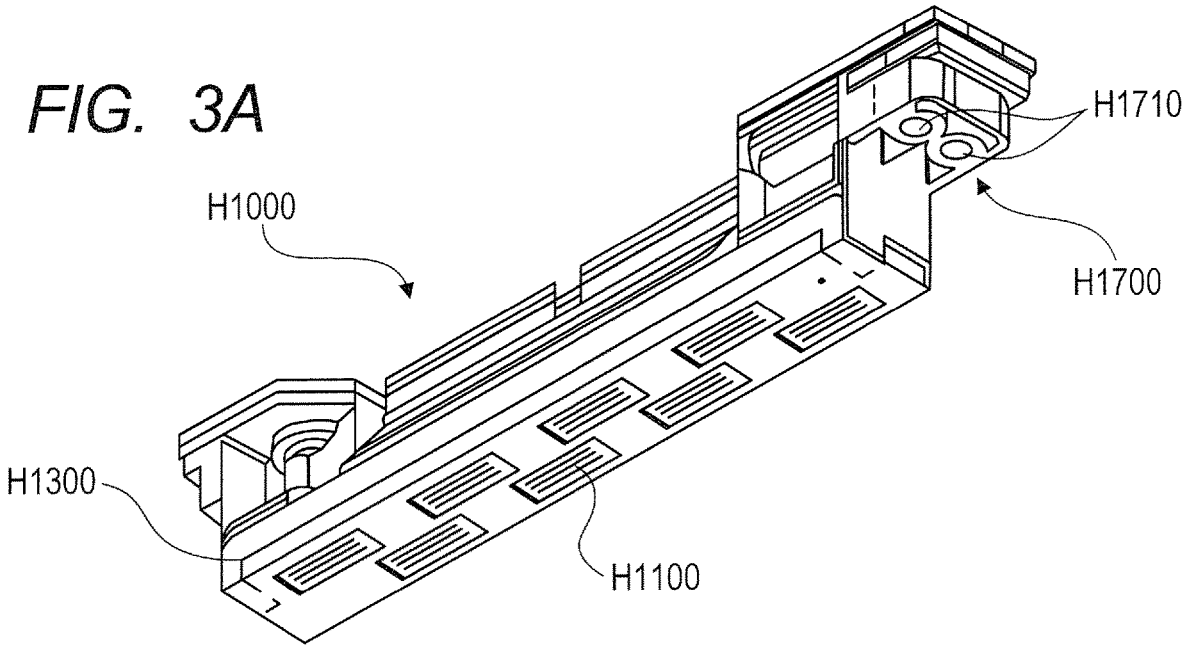
Figure 3B:
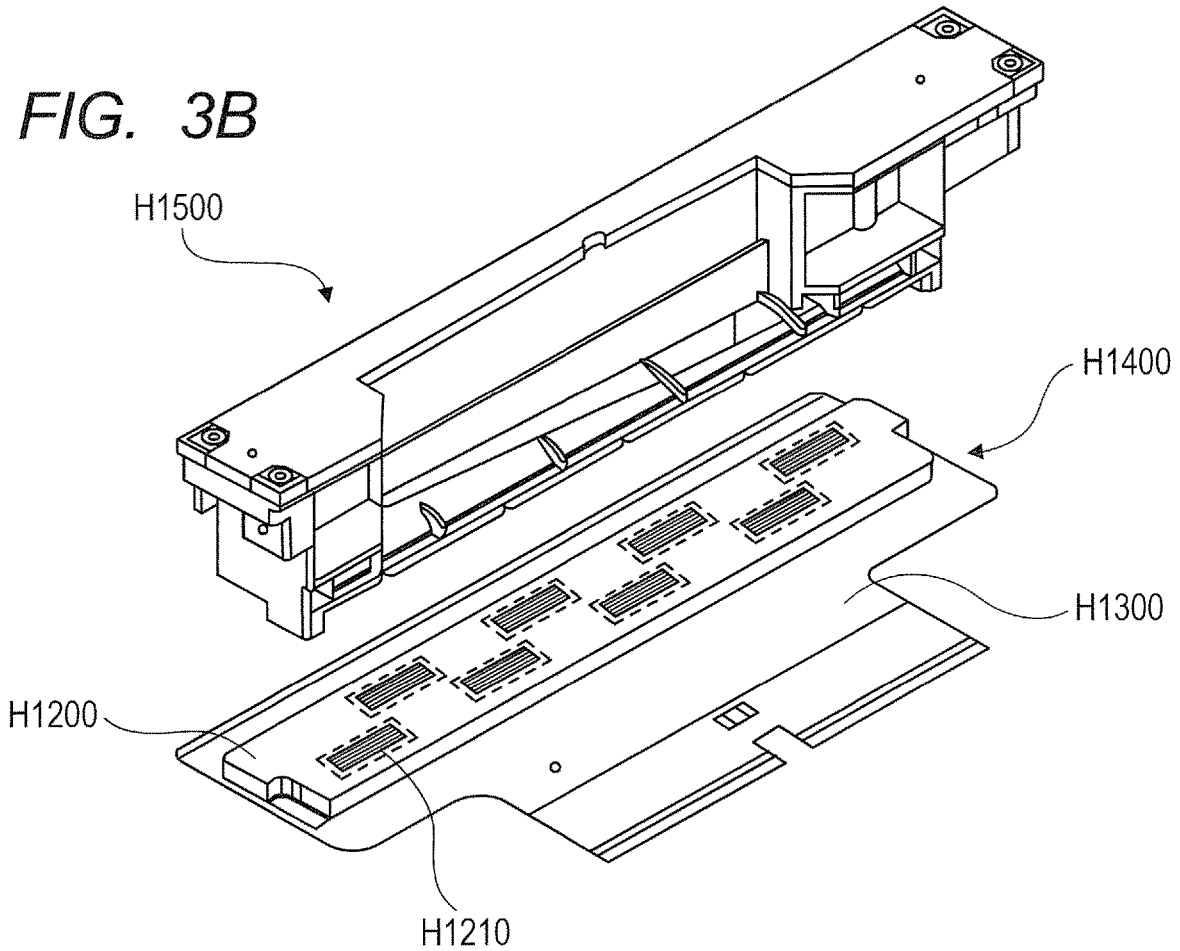

FIGS. 3A and 3B schematically show one example of a line head, in which FIG. 3A is a perspective view and FIG. 3B is an exploded perspective view. As shown in FIGS. 3A and 3B, the line head (recording head H1000) is equipped with a recording element unit H1400 and an ink supply unit H1500 which is a liquid supply unit for supplying an ink to the recording element unit H1400. The ink supply unit H1500 is equipped with a connection portion H1700 having therein a connection port H1710 to be connected with the outside for supplying the ink to an ink chamber (not shown) from the outside such as the recording apparatus. The recording element unit H1400 is comprised of a recording element substrate H1100, a support substrate H1200, and a wiring member H1300.

The support substrate H1200 is a member for holding and fixing the recording element substrate H1100 and the wiring member H1300 and it has therein an ink supply hole H1210 for supplying the recording element substrate H1100 with an ink supplied from the ink supply unit H1500. A plurality of recording element substrates H1100 are arranged and fixed on the main surface of the support substrate H1200 with predetermined positional accuracy. The plurality of recording element substrates H1100 is arranged in staggered manner on the support substrate H1200 such that their nozzles are arranged continuously along a direction of a nozzle array between the recording element substrates H1100 adjacent to each other. Thus, since the recording element substrates H1100 are arranged while overlapping the nozzles at the joint of the adjacent recording element substrates H1100 to enable correction of the influence of the misalignment of the recording element substrates on an image, a full line type recording head having a long recording width can be achieved.

The wiring member H1300 is electrically connected with each of the recording element substrates H1100 so as to send electrical signals or power for driving a recording element provided on the recording element substrate H1100 from the outside of the recording head H1000 (recording apparatus) to the recording element substrate H1100. As the wiring member H1300, a printed wiring board having flexibility such as flexible wiring board is used. The wiring member H1300 having flexibility is folded to facilitate electrical connection between the recording element substrate H1100 and the recording apparatus and fixed to the ink supply unit H1500.

Examples of an ink ejection system include a system of supplying an ink with dynamic energy and a system of supplying an ink with thermal energy. In the invention, a line head that ejects an ink by either of these systems is preferred.

Figure 6:
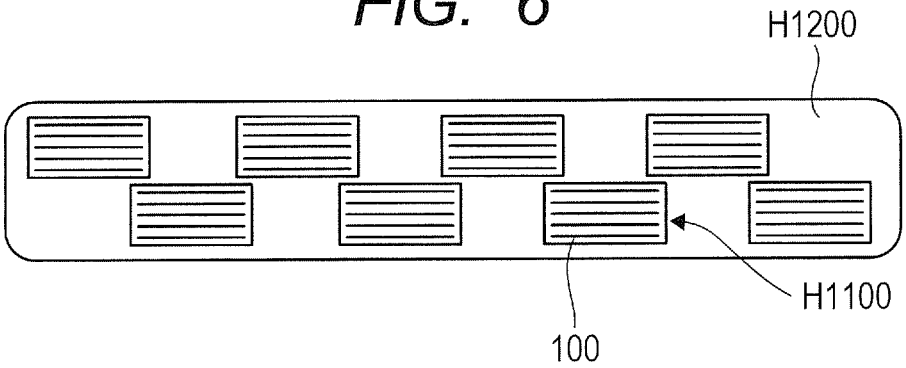
FIG. 6 is a schematic view showing one example of an arrangement mode of recording element substrates in a line head.
Figure 7:
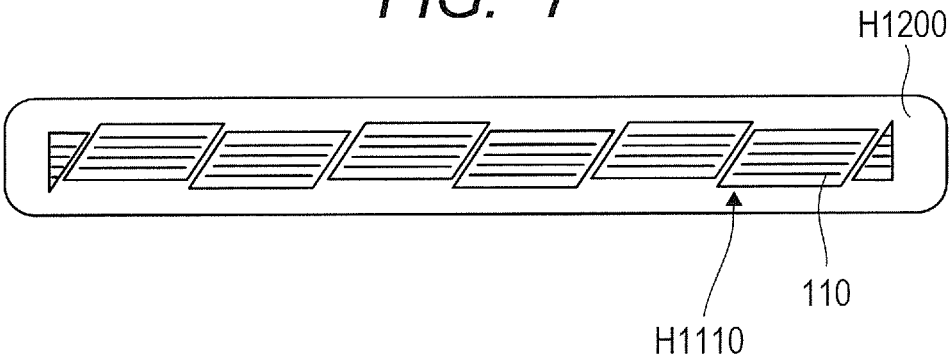
FIG. 7 is a schematic view showing another example of the arrangement mode of recording element substrates in a line head.

FIG. 6 is a schematic view showing one example of an arrangement mode of recording element substrates in a line head. As shown in FIG. 6, the line head constituting the ink jet recording apparatus of the invention is equipped with a plurality of recording element substrates H1100 each having a nozzle array 100 comprised of a plurality of ink ejection nozzles arranged in a predetermined direction. The plurality of recording element substrates H1100 are arranged in the predetermined direction (direction same as that of the nozzle arrangement direction) and held on a support substrate H1200. The arrangement mode of the recording element substrates is not particularly limited. Examples of the arrangement mode of the recording element substrates include arrangement in staggered manner as shown in FIG. 6 and arrangement, in inline manner, of the plurality of recording substrates H1110 each having a nozzle array 110 as shown in FIG. 7.

In the invention, an ink is ejected so as to satisfy the relationship Te>Tc, wherein Te (° C.) means an average temperature of an ink ejected from terminal-portion nozzles constituting the terminal portion of a nozzle array and Tc (° C.) means an average temperature of an ink ejected from center-portion nozzles constituting the center portion of the nozzle array. In order to satisfy the above-described relationship, the ink jet recording apparatus of the invention is therefore equipped with a unit for controlling the relationship between the ink average temperature Te (° C.) and the ink average temperature Tc (° C.) (unit for controlling the ink temperature).

The temperature of an ink in the line head can be controlled, for example, by a unit for controlling the temperature of the line head. Examples of the unit for controlling the temperature of the line head include an ink temperature regulation heater provided so as to be brought into contact with the line head and an ink ejection heater. For controlling the temperature (heating or warming) of the ink by the ink ejection heater, it is only necessary, for example, to repeat application of an electric current to such an extent that it does not cause ejection of the ink. The temperature of the ink can be read, for example, by a temperature sensor provided in the line head. The temperature of the line head and the ink is preferably adjusted to from 40 to 70° C.

Figure 4A:
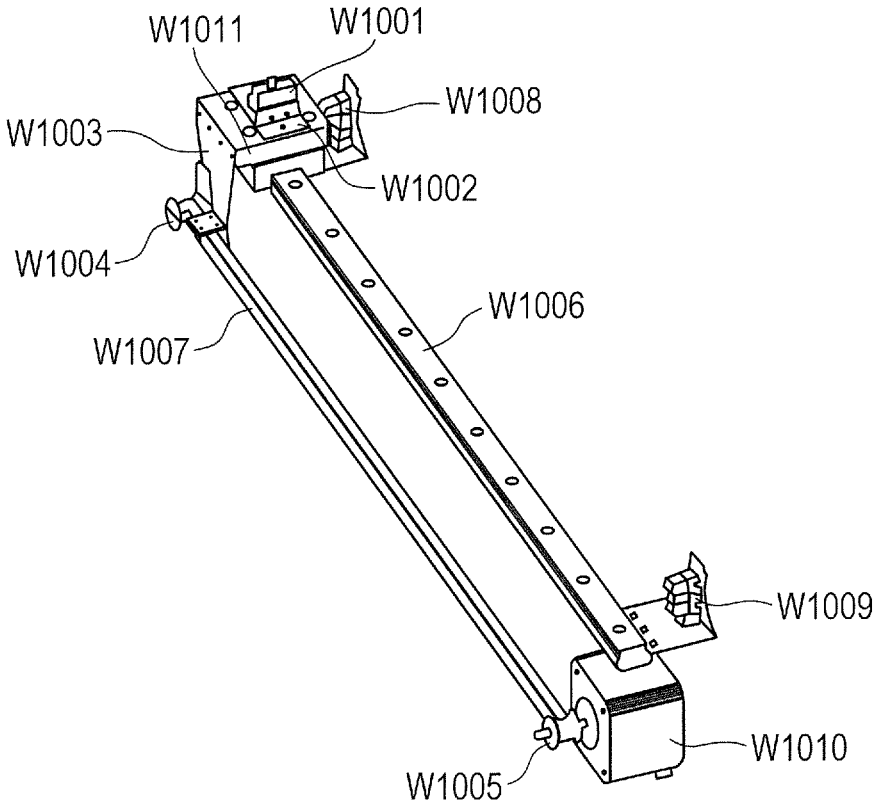
Figure 4B:
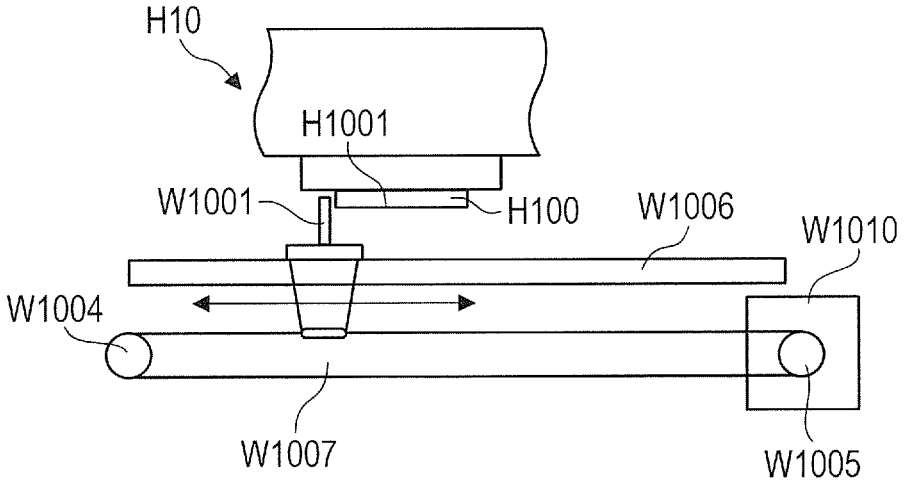

The ink jet recording apparatus to be used in the ink jet recording method of the invention may be equipped further with a recovery mechanism for recovering from film adhesion of an ink to the ejection orifice (nozzle) of the line head or wetting of the surface of the ejection orifice. FIGS. 4A and 4B show one example of the wiping mechanism, in which FIG. 4A is a perspective view and FIG. 4B is a schematic view. As shown in FIGS. 4A and 4B, a wiper W1001 is held by a clip member W1002 and the clip member W1002 is held by a linking member W1003. The clip member W1002 is attached to a wipe base W1011 capable of travelling on a slide rail W1006. The wipe base W1011 can travel on the slide rail W1006, driven by a timing belt W1007 through the linking member W1003. The timing belt W1007 is supported by a driven pulley W1004 and a driving pulley W1005. To the driving pulley W1005, the shaft of a driving motor W1010 for driving the timing belt W1007 is linked. For controlling the position of the wiper W1001 at the time of recovery operation, the slide rail W1006 has, at both ends thereof, photo sensors W1008 and W1009. At the time of recovery operation by wiping, the wiper W1001 slides and moves by means of the slide rail W1006 and thereby, the wiper W1001 wipes the ejection orifice surface H1001 of a recording head H1000 while bending.

Figure 5:
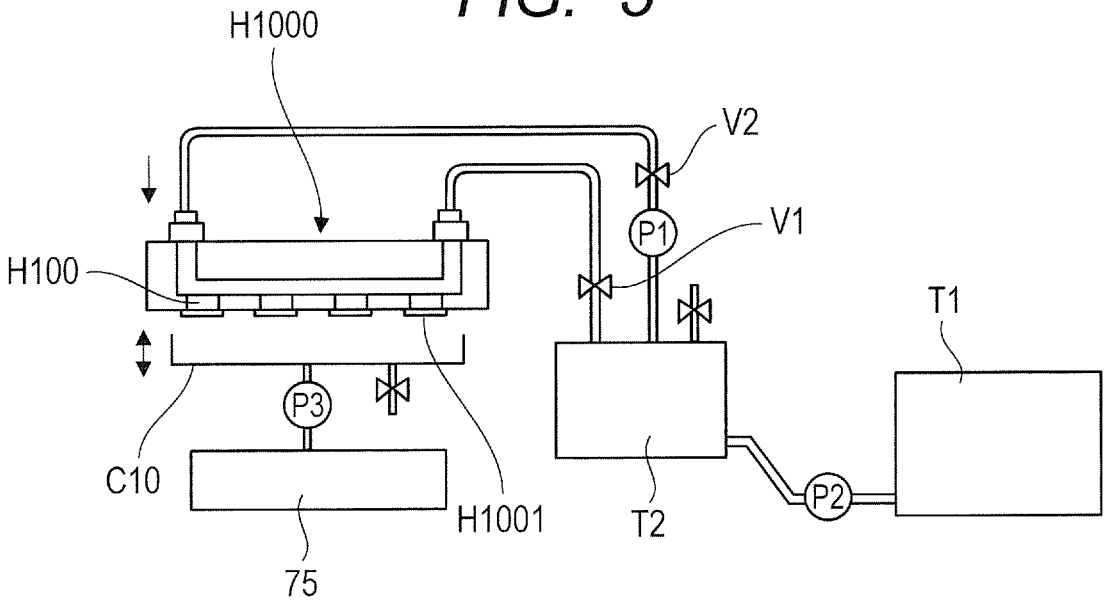
FIG. 5 is a schematic view showing one example of a mechanism for supplying a line head with an ink.

The ink jet recording apparatus to be used in a liquid ejection method of the invention may further be equipped with a mechanism of supplying the line head with a liquid such as ink. FIG. 5 is a schematic view showing one example of a supply mechanism for supplying an ink to the line head. As shown in FIG. 5, the ink is supplied from a sub tank T2 to the line head H1000 with a pump P1. The ink overflowing from the line head H1000 is returned to the sub tank T2. A valve V1 is provided for switching between pressurization and release of pressure in an ink chamber inside the line head at the time of recovery operation. At the time of recovery by pressurization, the valve V1 is closed and pressurization is performed with the pump P1 to remove some of bubbles from an ink supply path and an ink flow path. The liquid level of the ink in the sub tank T2 is constituted so that a water head difference with the ejection orifice surface of the line head H1000 is kept within a certain range, by which the negative pressure of the ejection orifice surface of the line head H1000 is kept within an appropriate range. When an amount of the ink in the sub tank T2 is not enough, an ink is delivered from a main tank T1 to the sub tank T2 with a pump P2. The temperature of the tanks and inks housed therein depends on the environmental temperature at which the ink jet recording apparatus is placed. For example, a temperature within a range of from 15 to 45° C. is preferred.

As a recording medium on which an image is to be recorded by the ink jet recording method of the invention, any media may be used. Among them, paper having permeability is preferred. Examples include recording media without a coating layer such as plain paper and non-coated paper and recording media having a coating layer such as glossy paper and art paper. In particular, recording media having a coating layer, such as glossy paper or art paper are preferred.

(Ink)

Components constituting an ink to be used in the ink jet recording method of the invention and physical properties of the ink will hereinafter be described in detail. The ink to be used in the invention is not necessarily a so-called "curable ink". The ink to be used in the invention therefore does not necessarily contain a compound such as polymerizable monomer which can be polymerized by application of external energy.

[Coloring Material]

The ink to be used in the ink jet recording method of the invention preferably contains a coloring material. As the coloring material, any of a dye and a pigment can be used. Examples of the dye include anionic-group-containing ones. As the dye, compounds having a skeleton such as phthalocyanine, azo, xanthene, or anthrapyridone can be used. Examples of the pigment include inorganic pigments and organic pigments. As the pigment, usable are resin-dispersed type pigments using a resin as a dispersant and self-dispersible type pigments (self-dispersible pigments) having a hydrophilic group introduced into the surface of pigment particles. In the ink jet recording method of the invention, using the pigment as the coloring material is preferred. In this case, using a dispersion system not making use of a resin dispersant is preferred, with using a self-dispersible pigment being more preferred.

Examples of the resin-dispersed type pigments include resin-dispersed pigments using a polymer dispersant, microcapsule type pigments obtained by covering the surface of pigment particles with a resin, and resin-bound type pigments obtained by chemically binding a polymer-containing organic group to the surface of pigment particles. Pigments different in dispersion method may be used in combination. As the resin, acrylic resins having at least an anionic-group-having unit such as (meth)acrylic acid and an anionic-group-free unit such as a monomer having an aromatic ring or aliphatic group are preferred.

Examples of the self-dispersible type pigments include those obtained by binding an anionic group to the surface of pigment particles directly or via another atomic group. Examples of the anionic group include carboxylic acid group, sulfonic acid group, phosphoric acid group, and phosphonic acid group. Examples of the counter ion of the anionic group include cations such as hydrogen atom, alkali metals, ammonium, and organic ammoniums. The "other atomic group" has a function of a spacer between the surface of pigment particles and the ionic group and has preferably a molecular weight of 1000 or less. Examples of the other atomic group include alkylene groups having from about 1 to 6 carbon atoms, arylene groups such as phenylene and naphthylene, ester groups, imino groups, amide groups, sulfonyl groups, and ether groups. The other atomic group may be a combination of these groups.

The content (% by mass) of the coloring material in the ink is preferably 0.10% by mass or more to 15.00% by mass or less, more preferably 1.00% by mass or more to 10.00% by mass or less, each based on the total mass of the ink. Of these, 2.00% by mass or more to 10.00% by mass or less is particularly preferred. The content of the coloring material less than 2.00% by mass may reduce the optical density of an image to be recorded. The content of the coloring material more than 10.00% by mass, on the other hand, may deteriorate the ejection stability.

[Aqueous Medium]

The ink contains at least water as an aqueous medium. The water used is preferably deionized water (ion-exchanged water). The ink has preferably a water content (% by mass) of 50.00% by mass or more to 95.00% by mass or less, more preferably 60.00% by mass or more to 95.00% by mass or less, each based on the total mass of the ink.

The ink may also contain a water-soluble organic solvent as the aqueous medium. As the water-soluble organic solvent, any of those ordinarily used for inks to be used in an ink jet recording method can be used. Specific examples of the water-soluble organic solvent include alkyl alcohols having from 1 to 4 carbon atoms, amides, ketones or ketoalcohols, ethers, polyalkylene glycols, glycols, alkylene glycols having an alkylene group with from 2 to 6 carbon atoms, alkyl ether acetates, alkyl ethers of a polyhydric alcohol, and nitrogenous compounds. These water-soluble organic solvents may be used either singly or in combination. The content (% by mass) of the water-soluble organic solvent in the ink is preferably 3.00% by mass or more to 50.00% by mass or less, more preferably 5.00% by mass or more to 30.00% by mass or less, each based on the total mass of the ink.

The term "water-soluble organic solvent" usually means a liquid, but a solid at 25° C. (normal temperature) is also embraced in it in the invention for the convenience sake because it becomes a liquid medium constituting an ink after dissolved in water. Specific examples of the water-soluble organic solvent which is widely used for inks and in solid form at 25° C. include 1,6-hexanediol, trimethylolpropane, ethylene urea, urea, and polyethylene glycol having a number-average molecular weight of 1,000.

[Surfactant]

The ink may contain a surfactant. The content (% by mass) of the surfactant in the ink is preferably 0.10% by mass or more to 5.00% by mass or less, more preferably 0.25% by mass or more to 3.00% by mass or less, each based on the total mass of the ink. Specific examples of the surfactant include hydrocarbon-based surfactants such as ethylene oxide adducts of acetylene glycol, polyethylene glycol alkyl ethers, and polyoxyethylene polyoxypropylene block copolymers, fluorine-based surfactants such as perfluoroalkyl ethylene oxide adducts, and silicone-based surfactants such as polyether-modified siloxane compounds. Of these, the hydrocarbon-based surfactants are preferred. These surfactants may be used either singly or in combination.

[Other Components]

The ink may contain, in addition to the above-described components, various additives such as resin, pH regulator, rust preventive, antiseptic, antifungal agent, antioxidant, or reduction preventive in order to obtain an ink having desired physical property values if necessary.

[Physical Properties of Ink]

The ink has preferably a viscosity at 25° C. of 1.0 mPa·s or more to 5.0 mPa·s or less, more preferably 1.0 mPa·s or more to 3.0 mPa·s or less. The ink has preferably a surface tension at 25° C. of 45 mN/m or less. Using an ink having a surface tension more than 45 mN/m sometimes causes insufficient blurring of the ink on the recording medium and thereby reduces the suppressing effect of image streaks. On the other hand, the ink has preferably a surface tension at 25° C. of 15 mN/m or more, preferably 25 mN/m or more. The ink has preferably a pH at 25° C. of 5 or more to 9 or less.

EXAMPLES

The invention will hereinafter be described in further detail by Examples and Comparative Examples. The invention is not restricted to or by the following Examples insofar as it does not depart from the gist of the invention. All designations of "part or parts" and "%" are on a mass basis unless otherwise specifically indicated.

<Preparation of Pigment Dispersion>

(Pigment Dispersion 1)

A styrene/acrylic acid copolymer (composition (molar) ratio=33:67) added as a water-soluble resin was neutralized with one neutralization equivalent of potassium hydroxide. The neutralized resin was dissolved in ion-exchanged water to prepare an aqueous solution of a resin dispersant having a resin content of 20.0%. The water-soluble resin used had a weight average molecular weight of 10,000 and an acid value of 200 mgKOH/g. A mixture of 15.0 parts of a pigment (carbon black), 30.0 parts of the aqueous solution of a resin dispersant, and 55.0 parts of water was poured in a sand grinder and was subjected to dispersion treatment for one hour. After removal of coarse particles by centrifugal separation treatment, the residue was pressure filtered through Micro Filter (product of Fujifilm) having a pore size of 3.0 μm. Then, an adequate amount of ion exchanged water was added to obtain Pigment Dispersion 1. The resulting Pigment Dispersion 1 had a pigment content of 15.0% and a resin dispersant content of 6.0%.

(Pigment Dispersion 2)

Carbon black (90 g) having a CTAB specific surface area of 150 $m^2/g$ and a DBP oil absorption of 100 mL/100 g was added to 3000 mL of a 2.5 mol/L aqueous sodium sulfate solution. The resulting mixture was subjected to oxidation treatment by stirring for 10 hours at a temperature of 60° C. and at a rate of 300 rpm. The carbon black obtained by filtration was neutralized with an aqueous sodium hydroxide solution, and then ultrafiltered. After washing with water and drying, the filtrate was dispersed in ion exchanged water to obtain Pigment Dispersion 2. The resulting Pigment Dispersion 2 had a pigment content of 15.0%.

(Pigment Dispersion 3)

A water-soluble resin ("Joncryl67", trade name; product of BASF) was neutralized with one neutralization equivalent of potassium hydroxide. The neutralized resin was dissolved in ion-exchanged water to prepare an aqueous solution of a resin dispersant having a resin content of 20.0%. The water-soluble resin used had a weight average molecular weight of 12,500 and an acid value of 215 mgKOH/g. A mixture of 15.0 parts of a pigment (C.I. Pigment Blue 15:3), 30.0 parts of the aqueous solution of a resin dispersant, and 55.0 parts of water was poured in a beads mill filled with zirconia beads and was subjected to dispersion treatment for one hour. After removal of coarse particles by centrifugal separation treatment, the residue was pressure filtered through Micro Filter (product of Fujifilm) having a pore size of 3.0 μm. Then, an adequate amount of ion exchanged water was added to obtain Pigment Dispersion 3. The resulting Pigment Dispersion 3 had a pigment content of 15.0% and a resin dispersant content of 6.0%.

<Aqueous Dye Solution>

A 15.0% aqueous solution of C.I. Direct Black 195 was used as an "aqueous dye solution".

<Preparation of Ink>

Components (unit: %) listed in Table 1 were mixed and stirred sufficiently. The resulting mixture was then pressure filtered through a cellulose acetate filter having a pore size of 1.20 μm (product of Advantec) to prepare each ink. The surface tension at 25° C. of the ink thus prepared is shown in the lower portion of Table 1. The surface tension of the ink was measured using an automatic surface tensiometer ("CBVP-Z", trade name; product of Kyowa Interface Science) in an environment with a temperature of 25° C. and a humidity of 50%. In Table 1, "Acetylenol E100" is a trade name of a nonionic surfactant (product of Kawaken Fine Chemicals).

TABLE 1

Composition and properties of ink

| | Inks | | | | | |
|---|---|---|---|---|---|---|
| | 1 | 2 | 3 | 4 | 5 | 6 |
| Pigment Dispersion 1 | 40.00 | | | | 40.00 | 40.00 |
| Pigment Dispersion 2 | | 40.00 | | | | |
| Pigment Dispersion 3 | | | 40.00 | | | |
| Aqueous dye solution | | | | 40.00 | | |
| Glycerin | 10.00 | 10.00 | 10.00 | 10.00 | 10.00 | 10.00 |
| 2-Pyrrolidone | 5.00 | 5.00 | 5.00 | 5.00 | 5.00 | 5.00 |
| Triethylene glycol | 5.00 | 5.00 | 5.00 | 5.00 | 5.00 | 5.00 |
| Acetylenol E100 | 0.25 | 0.30 | 0.25 | 0.30 | 0.10 | 0.08 |
| Ion exchanged water | 39.75 | 39.70 | 39.75 | 39.70 | 39.90 | 39.92 |
| Surface tension (mN/m) | 40 | 40 | 40 | 40 | 45 | 46 |

<Evaluation>

(Composition of Head)

The following thermal ink jet type heads 1 to 5 which ejected an ink by application of thermal energy were provided. The heads 1 to 5 each have 512 nozzles per nozzle array, a nozzle density of 600 dpi per nozzle array, an ink ejection amount of 4 ng per nozzle, and two nozzle arrays per ink color.

[Head 1]

Figure 8:
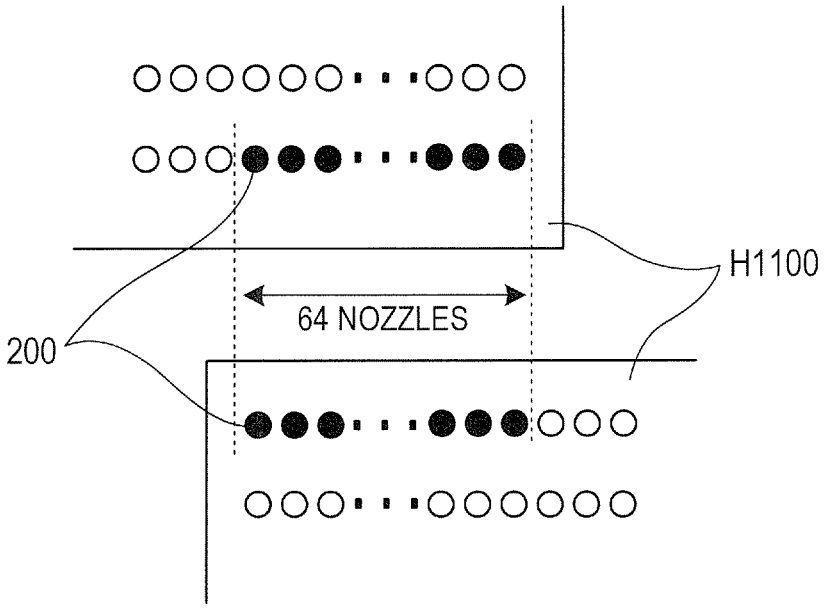
FIG. 8 is a schematic view showing an arrangement mode of nozzles of recording element substrates constituting a line head 1.

As shown in FIG. 6, this line head has a plurality of recording element substrates H1100 arranged in staggered manner. As shown in FIG. 8, the number of overlapping-portion nozzles 200 per nozzle array is 64.

[Head 2]

As shown in FIG. 6, this line head has a plurality of recording element substrates H1100 arranged in staggered manner. The number of overlapping-portion nozzles per nozzle array is 0.

[Head 3]

Figure 9:
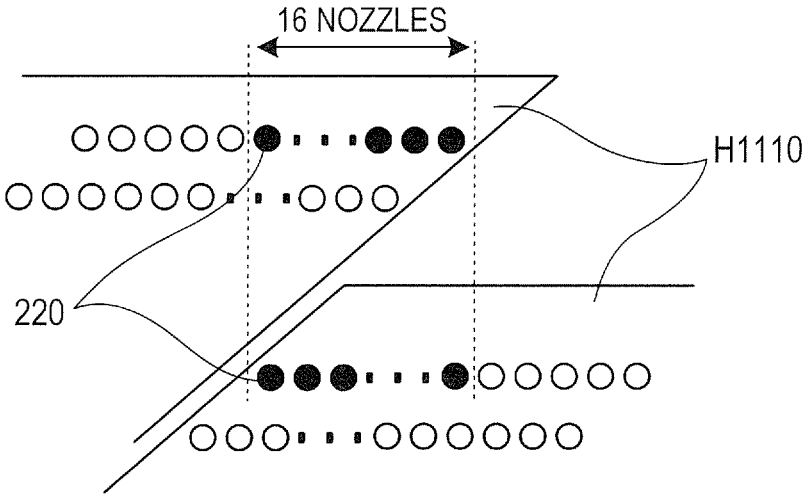
FIG. 9 is a schematic view showing an arrangement mode of nozzles of recording element substrates constituting a line head 3.

As shown in FIG. 7, this line head has a plurality of recording element substrates H1110 arranged in inline manner. As shown in FIG. 9, the number of overlapping-portion nozzles per nozzle array is 16.

[Head 4]

As shown in FIG. 7, this line head has a plurality of recording element substrates H1110 arranged in inline manner. The number of overlapping-portion nozzles per nozzle array is 0.

[Head 5]

This is a serial head making use of the recording element substrates constituting the head 1.

The constitution of each of the heads 1 to 5 is shown in Tale 2.

TABLE 2

| Constitution of head | | | | | |
|---|---|---|---|---|---|
| | 1 | 2 | 3 | 4 | 5 |
| Kind | Line head | Line head | Line head | Line head | Serial head |
| Arrangement mode of recording element substrates | Zigzag | Zigzag | Inline | Inline | — |
| The number of nozzles per nozzle array | 512 | 512 | 512 | 512 | 512 |
| The number of overlapping-portion nozzles per nozzle array | 64 | 0 | 16 | 0 | — |
| The number of center-portion nozzles per nozzle array | 256 | 256 | 256 | 256 | 256 |
| The number of terminal-portion nozzles per nozzle array*[1] | 15 | 15 | 15 | 15 | 15 |

*[1]The number of terminal-portion nozzles at one terminal portion of the nozzle array <Recording of Image>

For evaluation in Examples 1 to 13 and Comparative Examples 1 to 5, ink jet recording apparatuses having a constitution as shown in FIG. 2 and equipped with the heads 1 to 4 as a line head, respectively, were used. The heads are fixed to the ink jet recording apparatuses, respectively. These ink jet recording apparatuses each recorded an image by single scanning of a recording medium. After an ink storage portion was filled with each of the inks prepared above, the ink was delivered to the head with a pump. A solid image having 18 cm (longitudinal direction of the line head)×2 cm (paper feed direction) was recorded by using the apparatus and conveying a recording medium at a rate of 8 inch/sec under conditions of applying four ink droplets to a 1/600 inch×1/600 inch unit region (recording duty: 100%).

Evaluation was made in Reference Examples 1 and 2 by using an ink jet recording apparatus having a constitution similar to that shown in FIG. 2 except for the use of the head 5 as a serial head instead of the line head. This ink jet recording apparatus records an image corresponding to a unit region of a recording medium by single scanning of a recording head. A 2 cm (head scanning direction)×18 cm (paper feed direction) solid image was recorded by using this apparatus and allowing the head to scan at a rate of 8 inch/sec under conditions of applying four ink droplets to a 1/600 inch×1/600 inch unit region (recording duty: 100%).

As the recording medium, glossy paper ("Glossy Gold GL-101", trade name; product of Canon) was used. The temperature of the ink was controlled by applying a current to such an extent that the ink was not ejected to the heater of the line head and reading the temperature by a diode sensor provided in the line head. Combinations of the recording head, ink, and average ink temperatures Tc, Te, and Tj are shown in Table 3. The average ink temperature Tc (° C.) is an average temperature of the inks ejected from center-portion nozzles within a range of 256 nozzles from the center of the nozzle array. The average ink temperature Te (° C.) is an average temperature of the inks ejected from terminal-portion nozzles arranged at the terminal portions of the nozzles constituting the nozzle array. The average ink temperature Tj (° C.) is an average temperature of the inks ejected from the overlapping-portion nozzles.

<Evaluation of Image Streaks>

The resulting solid image at a position corresponding to a discontinuous position of the nozzle arrays (joint portion) was visually observed and image streaks were evaluated according to the following evaluation criteria. In the following evaluation criteria, those having an acceptable level are evaluated as "AAA", "AA", "A", or "B", while those having an unacceptable level are evaluated as "C". The results are shown in Table 3.

AAA: Streaks are almost unnoticeable and can be found only by careful observation.

AA: Slight streaks can be found visually but they are almost negligible.

A: Some streaks can be found visually but they are almost negligible.

B: Streaks can be found visually but they are mostly negligible.

C: Streaks are noticeable.

TABLE 3

| Conditions and Results of evaluation | | | | | | | |
|---|---|---|---|---|---|---|---|
| | | Head | Average temperature of ink Tc (° C.) | Average temperature of ink Te (° C.) | Average temperature of ink Tj (° C.) | Ink | Evaluation of image streaks |
| Examples | 1 | 1 | 35 | 45 | 45 | 1 | AAA |
| | 2 | 1 | 35 | 55 | 55 | 1 | AAA |
| | 3 | 1 | 45 | 55 | 55 | 1 | AAA |
| | 4 | 3 | 35 | 45 | 45 | 1 | AAA |
| | 5 | 1 | 35 | 45 | 45 | 2 | AAA |
| | 6 | 1 | 35 | 45 | 45 | 3 | AAA |
| | 7 | 1 | 35 | 45 | 45 | 4 | AAA |
| | 8 | 1 | 35 | 45 | 45 | 5 | AAA |
| | 9 | 1 | 35 | 45 | 45 | 6 | AA |
| | 10 | 1 | 35 | 45 | 42 | 1 | AA |
| | 11 | 1 | 35 | 40 | 40 | 1 | A |
| | 12 | 2 | 35 | 45 | — | 1 | A |
| | 13 | 2 | 35 | 40 | — | 1 | B |
| Comp. Ex. | 1 | 1 | 35 | 35 | 35 | 1 | C |
| | 2 | 2 | 35 | 35 | — | 1 | C |
| | 3 | 3 | 35 | 35 | 35 | 1 | C |
| | 4 | 4 | 35 | 35 | — | 1 | C |
| | 5 | 1 | 35 | 35 | 35 | 4 | C |
| Ref. Ex. | 1 | 5 | 35 | 45 | — | 1 | AAA |
| | 2 | 5 | 35 | 35 | — | 1 | AAA |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-110002, filed Jun. 1, 2016, and Japanese Patent Application No. 2017-100599, filed May 22, 2017, which are hereby incorporated by reference herein in their entirety.

What is claimed is:

1. An ink jet recording method that records an image on a recording medium using an ink jet recording apparatus equipped with a line head, the line head including a plurality of recording element substrates each having a nozzle array comprised of a plurality of nozzles that eject an aqueous ink, the nozzles being arranged in a predetermined direction, and the recording element substrates being arranged in the predetermined direction such that the recording element substrates constitute overlapping portions at which terminal portions of the recording element substrates are overlapped with terminal portions of adjacent recording element substrates in the predetermined direction, the method comprising controlling an average temperature Te (° C.) of the aqueous ink to be ejected from terminal-portion nozzles, constituting the terminal portion of each of the nozzle arrays, and an average temperature Tc (° C.) of the aqueous ink to be ejected from center-portion nozzles, constituting a center portion of each of the nozzle arrays, so that the average temperatures Te and Tc satisfy the following relationship: Te>Tc.

2. The ink jet recording method according to claim 1, wherein the average temperature Te (° C.) of the aqueous ink to be ejected from the terminal-portion nozzles and the average temperature Tc (° C.) of the aqueous ink to be ejected from the center-portion nozzles satisfy the following relationship: Te≥Tc+10.

3. The ink jet recording method according to claim 1, further comprising setting an average temperature Tj (° C.) of the aqueous ink to be ejected from overlapping-portion nozzles constituting the overlapping portions and the average temperature Tc (° C.) of the aqueous ink to be ejected from the center-portion nozzles so that the average temperatures Tj and Tc satisfy the following relationship: Tj>Tc.

4. The ink jet recording method according to claim 3, wherein the average temperature Tj (° C.) of the aqueous ink to be ejected from the overlapping-portion nozzles and the average temperature Tc (° C.) of the aqueous ink to be ejected from the center-portion nozzles satisfy the following relationship: Tj≥Tc+10.

5. The ink jet recording method according to claim 1, wherein the aqueous ink has a surface tension at 25° C. of 45 mN/m or less.

6. An ink jet recording apparatus for use with the ink jet recording method according to claim 1, the inkjet recording apparatus comprising the line head.

7. The ink jet recording method according to claim 1, wherein the recording medium has a coating layer.

8. The ink jet recording method according to claim 1, wherein the recording medium has no coating layer.

9. The ink jet recording method according to claim 1, wherein the aqueous ink comprises a coloring material.

10. The ink jet recording method according to claim 9, wherein the coloring material comprises a dye.

11. The ink jet recording method according to claim 9, wherein the coloring material comprises a pigment.

12. The ink jet recording method according to claim 11, wherein the pigment comprises a self-dispersible pigment.

13. The ink jet recording method according to claim 11, wherein the pigment is dispersed by a resin dispersant.

14. The ink jet recording method according to claim 1, wherein the aqueous ink comprises a surfactant.

15. The ink jet recording method according to claim 1, wherein the aqueous ink has a surface tension at 25° C. of 15 mN/m or more.

16. The ink jet recording method according to claim 1, wherein, in the controlling, the average temperature Tc (° C.) is adjusted to 15° C. or more to 60° C. or less.

17. The ink jet recording method according to claim 1, wherein, in the controlling, the average temperature Te (° C.) is adjusted to 25° C. or more to 70° C. or less.

18. The ink jet recording method according to claim 1, wherein the line head ejects the aqueous ink by supplying the aqueous ink with thermal energy.

19. The ink jet recording method according to claim 1, wherein the plurality of recording element substrates are arranged in a staggered manner.

20. The ink jet recording method according to claim 1, wherein the plurality of recording element substrates are arranged in an inline manner.

21. The ink jet recording method according to claim 1, wherein the average temperature Te is controlled by an ink temperature regulation heater configured to be brought into contact with the line head.

22. The ink jet recording method according to claim 1, wherein the average temperature Te is controlled by supplying an ink ejection heater with an electrical current to such an extent that it does not cause ejection of the aqueous ink.

23. The ink jet recording method according to claim 1, wherein the line head further comprises a support substrate for holding the plurality of recording element substrates.

24. The ink jet recording method according to claim 1, wherein the line head comprises an ink ejection heater, and wherein the average temperature Te is controlled by supplying the ink ejection heater with an electrical current to such an extent that it does not cause ejection of the aqueous ink.

25. The ink jet recording method according to claim 1, wherein the aqueous ink ejected from the terminal-portion nozzles blurs on the recording medium more easily than the aqueous ink ejected from the center-portion nozzles.

26. The ink jet recording method according to claim 1, wherein the average temperature Te is obtained by a sensor prior to an ejection operation, and wherein the average temperature Tc is obtained by a sensor prior to an ejection operation.

27. The ink jet recording method according to claim 1, wherein the average temperature Te is obtained by a sensor in the line head prior to an ejection operation, and wherein the average temperature Tc is obtained by a sensor in the line head prior to an ejection operation.

* * * * *